US006683254B1

(12) United States Patent
Gunnels

(10) Patent No.: US 6,683,254 B1
(45) Date of Patent: Jan. 27, 2004

(54) LOW LOSS CABLE COUPLER

(75) Inventor: Robert Gunnels, Lockport, IL (US)

(73) Assignee: Andrew Corp., Orland Park, IL (US)

( * ) Notice: Subject to any disclaimer, the term of this patent is extended or adjusted under 35 U.S.C. 154(b) by 15 days.

(21) Appl. No.: 10/065,265

(22) Filed: Sep. 30, 2002

(51) Int. Cl.[7] ..... H01R 4/00
(52) U.S. Cl. ..... 174/84 R; 174/88 R; 174/88 C
(58) Field of Search ..... 174/74 R, 74 A, 174/75 F, 78, 80, 84 R, 88 R, 85, 88 C; 333/125, 127, 136, 24 R; 29/876, 877, 878; 439/578, 579, 580, 582, 620, 941

(56) References Cited

U.S. PATENT DOCUMENTS

| | | | | | |
|---|---|---|---|---|---|
| 1,675,163 | A | * | 6/1928 | Colburn | 439/100 |
| 2,891,222 | A | * | 6/1959 | Freen | 333/124 |
| 3,141,060 | A | * | 7/1964 | Norton | 174/73.1 |
| 3,602,872 | A | | 8/1971 | Braunstein | |
| 4,365,859 | A | * | 12/1982 | Hutter et al. | 439/425 |
| 4,738,009 | A | | 4/1988 | Down | |
| 4,795,356 | A | | 1/1989 | Pauza | |
| 5,281,933 | A | | 1/1994 | Chamberlin | |
| 5,382,932 | A | * | 1/1995 | Monti | 333/245 |
| 5,689,218 | A | * | 11/1997 | Stein et al. | 333/125 |
| 6,312,281 | B1 | | 11/2001 | Rodriguez | |
| 6,362,709 | B1 | * | 3/2002 | Paxman et al. | 333/245 |
| 6,392,504 | B1 | * | 5/2002 | Stein | 333/125 |
| 6,417,456 | B1 | * | 7/2002 | Leijon et al. | 174/120 SC |

* cited by examiner

*Primary Examiner*—William H. Mayo, III
(74) *Attorney, Agent, or Firm*—Babcock IP, LLC

(57) ABSTRACT

A cable coupler between a trunk cable having a first center conductor and a first outer conductor and a second cable having a second center conductor and a second outer conductor. An aperture is formed in the first outer conductor; a probe having a capacitive element on a first end is inserted into the aperture to contact the first center conductor. A second end of the probe is coupled to the second center conductor. The first outer conductor and the second outer conductor may be coupled together directly or via a second capacitor. A cover may be added to secure the different components and or to provide environmental protection for the cable coupler. The capacitive element may be mounted on an insulating substrate. A range of capacitive elements may be used to achieve a desired coupling between the trunk cable and the second cable.

28 Claims, 5 Drawing Sheets

LOW LOSS CABLE COUPLER

BACKGROUND OF INVENTION

1. Field of the Invention

The invention relates to electrical cable couplers. More specifically, the invention relates to a "Piggy back" cable coupler with low insertion losses.

2. Description of Related Art

Many systems, for example in—building RF distribution systems or antenna arrays, utilize a trunk cable from which multiple connections, taps, are made. "Piggy back" type cable couplers permit the diversion of a signal from a trunk cable to a second cable, without requiring cutting of the trunk cable and installation of connectors.

Conventional "Piggy back " co-axial cable couplers introduce a contact pin through an aperture created in the trunk cable's outer conductor that contacts the trunk cable's center conductor. The contact pin of a conventional co-axial cable coupler creates a significant impedance discontinuity with mismatch loss. The mismatch loss, radiation and coupled energy losses, of a for example 10 dB coupler, may create an insertion loss of up to approximately 1.5 dB, with respect to the trunk cable, depending on the coupler, trunk cable type and the operating frequency. Where energy conservation is desired, or multiple couplers are required, the insertion loss from a conventional center conductor contacting co-axial cable coupler may be significant.

"Piggy back" type cable couplers using impedance transformers, capacitors or parasitic capacitances exist. However, these devices mount impedance transformers and or reactive components on a printed circuit board mounted in a coupler cover assembly. The probe of these cable couplers contacts the center conductor of the trunk cable and is then routed outside of the trunk cable's outer conductor to the printed circuit board. The impedance discontinuity created by the probes contact with the trunk cable center conductor increases insertion losses compared to the insertion losses of the present invention.

Power signal couplers with low insertion losses exist. However, these devices require cutting the trunk cable at a desired insertion point, installing connectors at both sides of the break and insertion of the coupler, in-line. The separate structure of the coupler, required connectors and time-consuming installation procedure may cause this type of coupler to be prohibitively expensive.

Competition within the coupler connector market has also focused attention on minimization of materials and manufacturing process costs.

Therefore, it is an object of the invention to provide a method, apparatus and a kit for a cable coupler that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
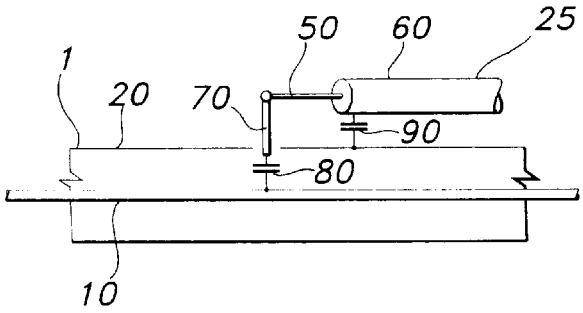
FIG. 1 shows a schematic cut-away side view of a first embodiment of the invention.

As shown in FIG. 1, RF energy in a trunk cable 1 propagates in a space between a center conductor 10 and a surrounding outer conductor 20. To couple the RF energy into a second cable 25 having a second center conductor 50 and a second outer conductor 60, a probe 70 coupled with the second center conductor 50 is inserted through an aperture in the outer conductor 20, into mechanical contact with the center conductor 10. To minimize an impedance discontinuity as a result of contact by the probe 70 with the center conductor 10, a capacitor 80 may be located in-line between the center conductor 10 and second center conductor 50, on or along the probe 70, at a location between the center conductor 10 and the aperture in the outer conductor 20. The outer conductor 20 and the second outer conductor 60 may be coupled together directly or capacitively coupled by proximity or a second capacitor 90.

The capacitor 80 may be, for example, an approximately 1.0 picofarad capacitor. Various different types of capacitors may be used, for example surface mount chip capacitors, ceramic, air or thin film capacitors. Very small capacitors may be used with smaller diameter probes 70 and trunk cables 1.

Figure 2:
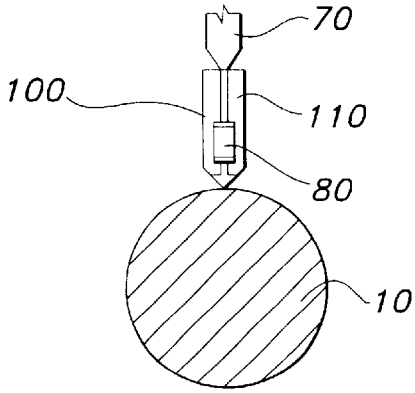
FIG. 2 shows a close-up cross sectional view of a capacitor assembly, according to the invention.

A capacitor assembly 100 with an insulating substrate 110, for example a printed circuit board, may be used, as shown in FIG. 2. A range of capacitors each having different capacitance values, mounted on different insulating substrates 110 allows field selection of the capacitance value providing best performance with respect to the characteristics of trunk cable 1 and a desired operating frequency. Different values of capacitance may be easily and quickly applied by substituting different capacitor assemblies 100, for example designed in a cartridge configuration dimensioned for easy insertion into the aperture in the outer conductor 20, each capacitor assembly 100 having a different value capacitor 80 mounted thereon/therein.

Figure 3:
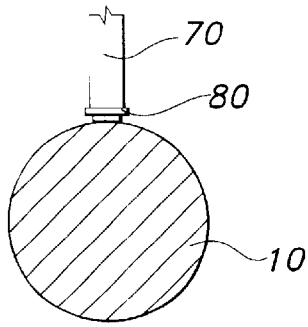
FIG. 3 shows a close-up cross sectional view of a probe mounted capacitor embodiment, according to the invention.
Figure 4:
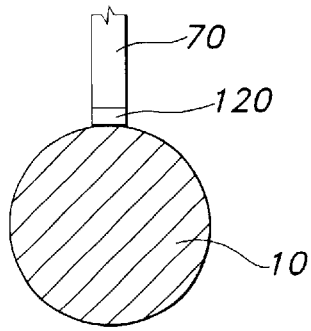
FIG. 4 shows a close-up cross sectional view of a parasitic capacitor embodiment, according to the invention.

As shown in FIG. 3, the capacitor 80 may also be mounted on the tip of the probe 70 with one contact of capacitor 80 coupled with the probe 70 and the other located so that it contacts the center conductor 10. In another embodiment, as shown in FIG. 4 (not to scale), a parasitic capacitance may be generated by locating an appropriately sized dielectric spacer 120, between the contact point of the probe 70 and the center conductor 10. The dielectric spacer 120 may also be formed by coating at least the center conductor 10 contacting area of the probe 70 with dielectric material of a suitable thickness.

In an alternative embodiment, a trimmer capacitor may be used to provide a single capacitor 80 and or capacitor assembly 100 that is adjustable to provide a specific desired capacitance.

Figure 5A:
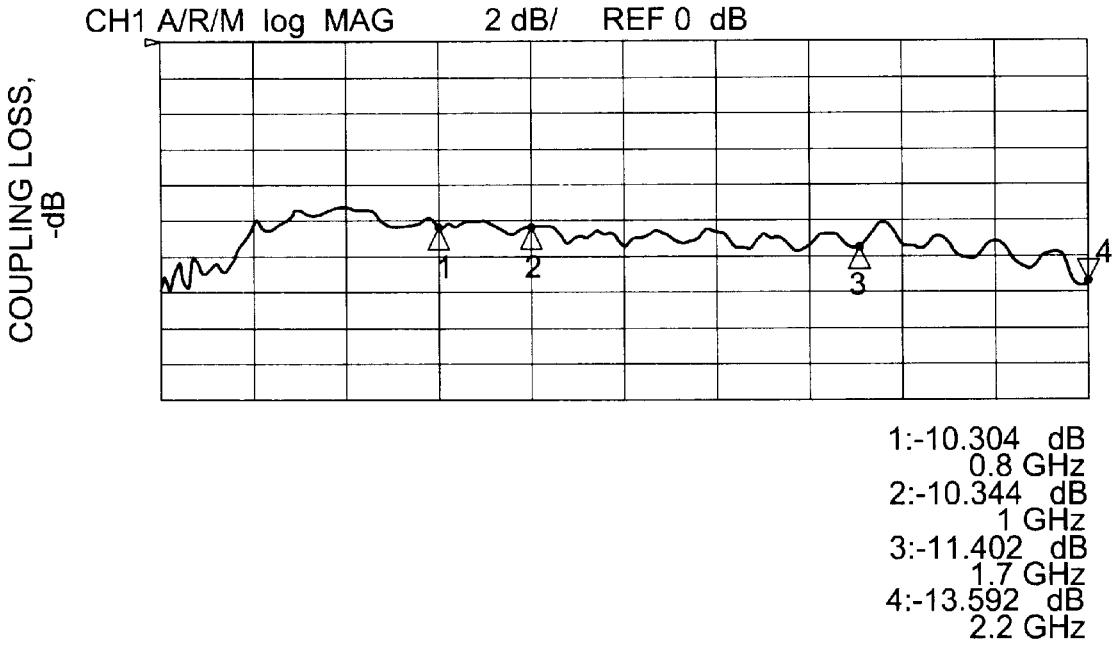
FIG. 5*a* shows test data representing the coupling factor of a conventional direct contact cable coupler with respect to operating frequency.
Figure 5B:
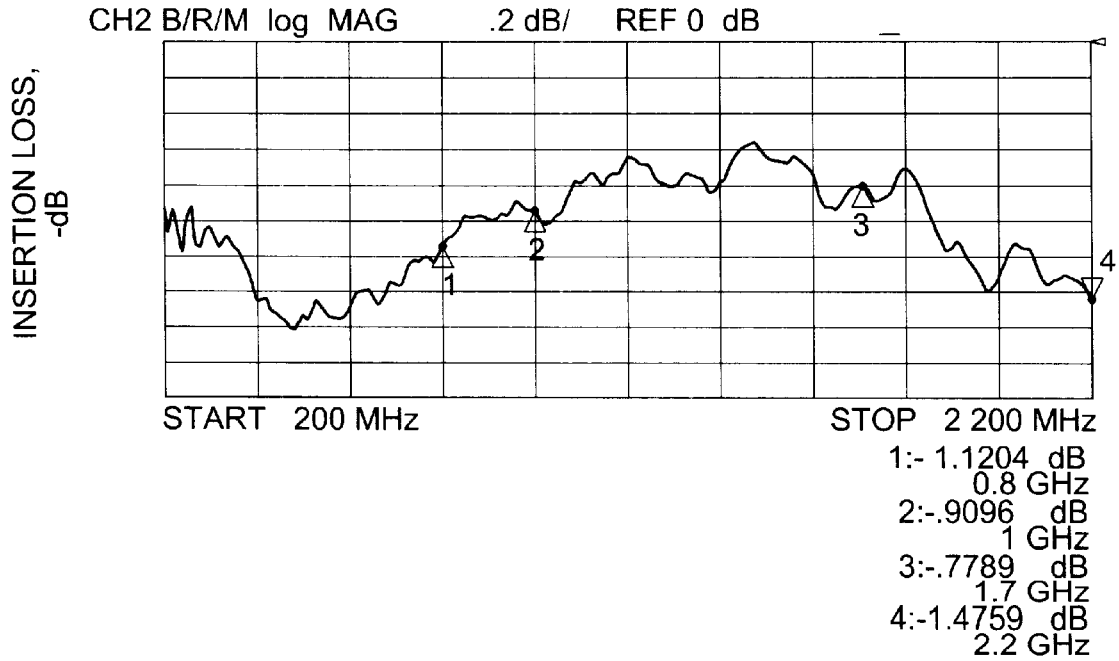
FIG. 5*b* shows test data representing the insertion loss of a conventional direct contact cable coupler with respect to operating frequency.
Figure 6A:
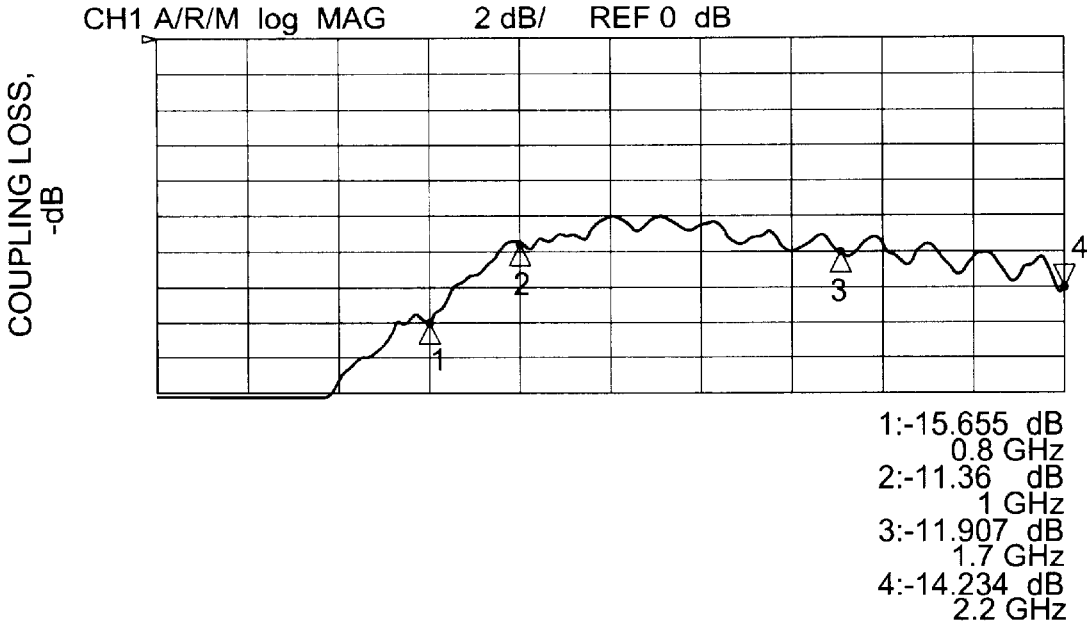
FIG. 6*a* shows test data representing the coupling factor of a cable coupler according to the invention (0.5 pF capacitor) with respect to operating frequency.
Figure 6B:
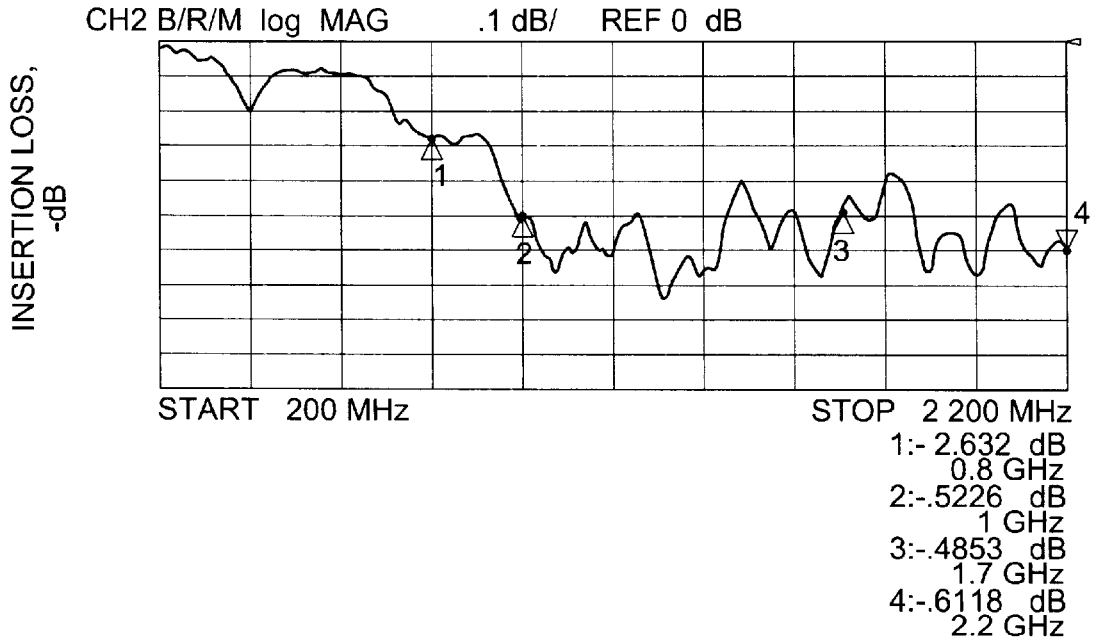
FIG. 6*b* shows test data representing the insertion loss of a cable coupler according to the invention (0.5 pF capacitor) with respect to operating frequency.
Figure 7A:
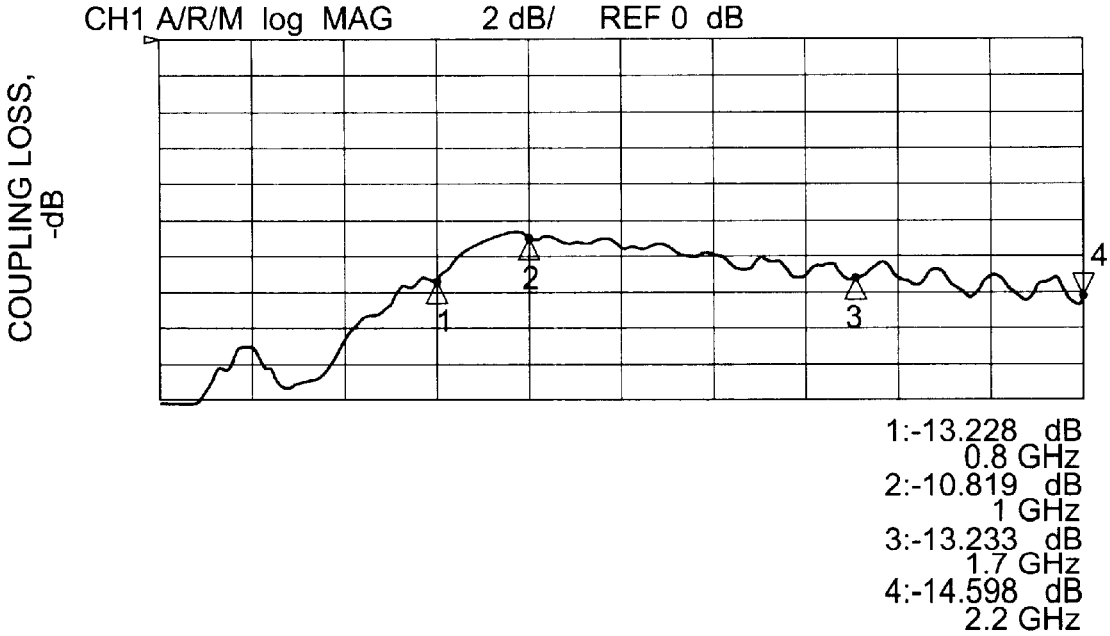
FIG. 7*a* shows test data representing the coupling factor of a cable coupler according to the invention (1.0 pF capacitor) with respect to operating frequency.
Figure 7B:
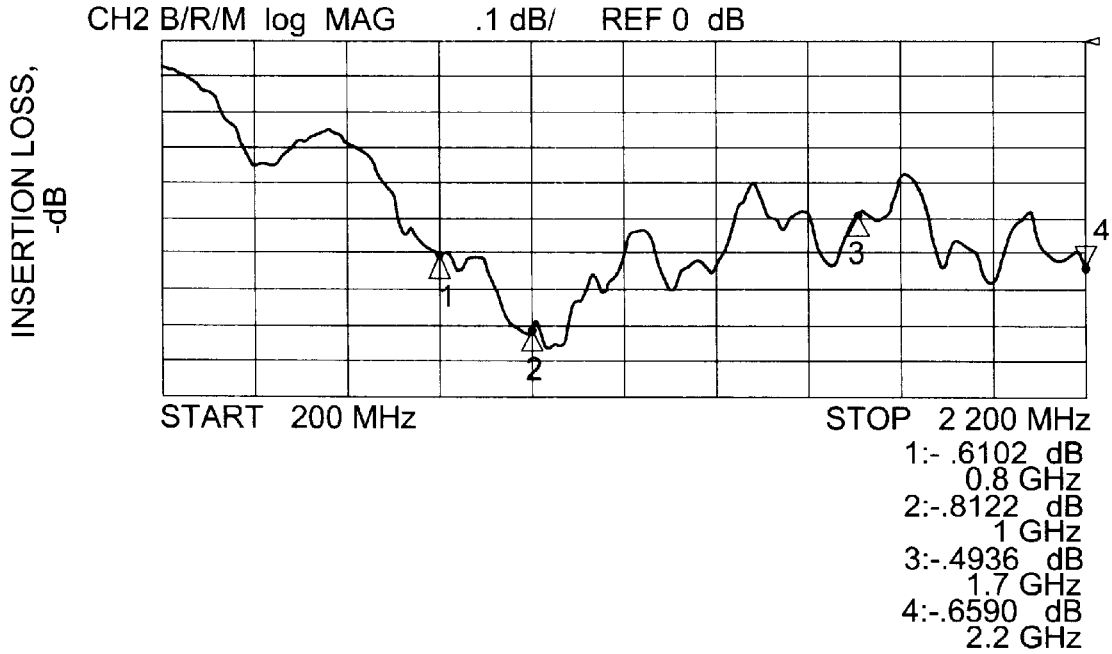
FIG. 7*b* shows test data representing the insertion loss of a cable coupler according to the invention (1.0 pF capacitor) with respect to operating frequency.

Test data of a conventional cable coupler with a direct probe to center conductor connection is shown in FIGS. 5*a* and 5*b*. FIG. 5*a* shows insertion loss and FIG. 5*b* shows coupling factor over a frequency range of 0.2 to 2.2 Gigahertz. Test data of a cable coupler with a 0.5 picofarad capacitor located at the contact point between the probe 70 and the center conductor 10, is shown in FIGS. 6*a* and 6*b*. FIG. 6*a* shows insertion loss and FIG. 6*b* shows coupling factor over a frequency range of 0.2 to 2.2 Gigahertz. FIGS. 7*a* and 7*b* demonstrate the same test configuration/range, using a 1.0 picofarad capacitor. Because the creation of an impedance discontinuity is reduced, reflective losses and therefore overall insertion loss due to the addition of the second coaxial cable 25 to the trunk cable 1 is reduced. For comparison, the coupling factors of each device are intended to be in the area of 10 dB. However, the coupling factors have not been tuned to be exactly the same and therefore the different insertion losses should be viewed accordingly. Note that the insertion loss plot for FIG. 5*b* uses a scale of 0.2 dB, while FIGS. 6*b* and 7*b* have a scale of 0.1 dB. A comparison of FIGS. 5*a* and 5*b* with 6*a*, 6*b*, 7*a* and 7*b* demonstrates that the invention provides a significant decrease in insertion loss, when compared to the performance of prior direct contacting center conductor cable couplers.

Figure 8:
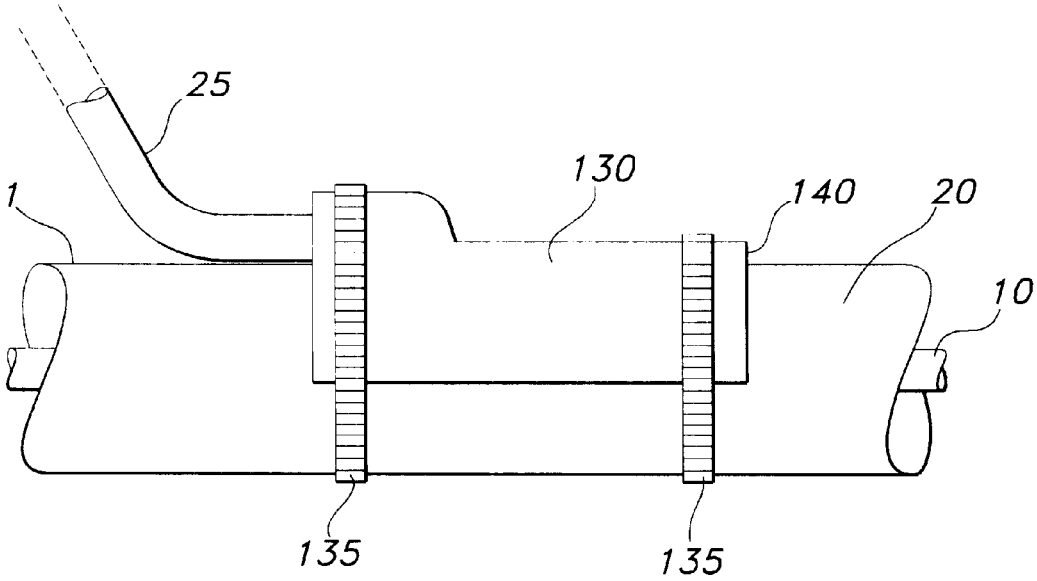
FIG. 8 shows an external side view of a coupler fitted to a trunk cable.

As shown in FIG. 8, the probe 70 and the second coaxial cable 25 may be held in position with and protected from environmental contaminants by, for example, an inexpensive and easy to attach cover 130 as shown in FIG. 7. Elongated straps 135 may be used to hold the cover 130 in place. Alternatively, adhesive, mechanical clamps and or other attachment means may also be used to secure the cover 130. The cover 130 may also include, insulated so as not to form a short circuit between the probe 70 and the aperture in the outer conductor 20, an RF shield 140 to minimize RF energy radiation losses/interference from the trunk cable 10 through the aperture and from any exposed portions of the probe 170 and the second center conductor 50. A typical cover/support assembly and attachment means is described in U.S. Pat. No. 6,312,281 "Coupler Connector" issued Nov. 6, 2001, assigned to Andrew Corporation and hereby incorporated by reference in the entirety.

As described, the low loss coupler provides the following advantages. The low loss coupler has a reduced insertion loss. The low loss cable coupler is tunable through the use of different capacitive inserts or parasitic capacitance dielectric spacers. Existing conventional center conductor contacting cable couplers and their cover assemblies may be adapted according to the invention with a minimum of required modifications.

Table of Parts

| | |
|---|---|
| 1 | trunk cable |
| 10 | center conductor |
| 20 | outer conductor |
| 25 | second cable |
| 50 | second center conductor |
| 60 | second outer conductor |
| 70 | probe |
| 80 | capacitor |
| 90 | second capacitor |
| 100 | capacitor assembly |
| 110 | insulating substrate |
| 120 | dielectric spacer |
| 130 | cover |
| 135 | elongated straps |
| 140 | RF shield |

Where in the foregoing description reference has been made to ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A cable coupler for coupling a trunk cable having a first center conductor and a first outer conductor having an aperture therein, with a second center conductor, comprising:

a probe with a first contact of a capacitor connected to a first end;

the probe configured for insertion through the aperture so that the capacitor is located between the first center conductor and the first outer conductor, and a second contact of the capacitor contacts the first center conductor; and the second center conductor is coupled to a second end of the probe.

2. The cable coupler of claim 1, wherein the capacitor is one of a surface mount chip, a ceramic, an air, a trimmer and a thin film capacitor.

3. The cable coupler of claim 1, wherein the capacitor is mounted on an insulating substrate.

4. The cable coupler of claim 3, wherein the insulating substrate is configured as a cartridge configured for insertion into the aperture.

5. The cable coupler of claim 1, wherein the second center conductor is electrically isolated from and surrounded by a second outer conductor to form a second cable;

a second capacitor coupling the second outer conductor of the second cable to the first outer conductor.

6. The cable coupler of claim 1, further including a cover, the cover configured to enclose a portion of the trunk cable having the aperture and a connection between the second center conductor and the second end of the probe.

7. The cable coupler of claim 6, wherein the cover is secured by at least one of an elongated strap, a mechanical clamp, and an adhesive.

8. The cable coupler of claim 6, wherein the cover has an RF shield.

9. The cable coupler of claim 8, wherein the RF shield is insulated from the probe and the second center conductor.

10. A cable coupler for coupling a trunk cable having a first center conductor and a first outer conductor having an aperture therein, with a second center conductor, comprising:

a probe with a dielectric spacer on a first end;

the probe configured for insertion through the aperture so that the dielectric spacer contacts the first center conductor; and the second center conductor is coupled to a second end of the probe.

11. The cable coupler of claim 10, wherein dielectric spacer is a dielectric coating applied to the probe.

12. The cable coupler of claim 10, wherein the second center conductor is electrically isolated from and surrounded by a second outer conductor to form a second cable;

a second capacitor coupling the second outer conductor of the second cable to the first outer conductor.

13. The cable coupler of claim 10, further including a cover;

the cover configured to enclose a portion of the trunk cable having the aperture and a connection between the second center conductor and the second end of the probe.

14. The cable coupler of claim 13, wherein the cover is secured by at least one of an elongated strap, a mechanical clamp, and an adhesive.

15. The cable coupler of claim 13, wherein the cover has an RF shield.

16. The cable coupler of claim 15, wherein the RF shield is insulated from the probe and the second center conductor.

17. A method for coupling a trunk cable having a first center conductor and a first outer conductor with a second cable having a second center conductor and a second outer conductor, comprising the steps of:

forming an aperture in the first outer conductor;

inserting a probe having a first contact of a capacitor coupled to a first end of the probe through the aperture so that the capacitor is locate between the center conductor and the first outer conductor, and a second contact of the capacitor contacts the first center conductor; and coupling the second center conductor to a second end of the probe.

18. The method of claim 17, wherein the capacitor is mounted on an insulating substrate.

19. The method of claim 18, wherein the insulating substrate is a cartridge configured for insertion into the aperture.

20. The method of claim 17, further including the step of coupling the first outer conductor to the second outer conductor.

21. The method of claim 20, wherein a second capacitor is inserted between the coupling of the first outer conductor and the second outer conductor.

22. The method of claim 17, further including the step of applying a cover over the aperture, probe and a connection area between the second center conductor and the second end of the probe.

23. A kit for coupling a trunk cable with a second cable, comprising:

a probe configured for insertion into an aperture formed in a first outer conductor of the trunk cable; and at least one capacitor configured for direct contact with a center conductor of the trunk cable.

24. The kit of claim 23, wherein the at least one capacitor is mounted on a first end of the probe.

25. The kit of claim 23, wherein the at least one capacitor is mounted on an insulating substrate configured for insertion into the aperture.

26. The kit of claim 23, wherein the at least one capacitor is a plurality of capacitors covering a range of capacitance values.

27. The kit of claim 23, further including at least one cover.

28. A cable coupler for coupling a trunk cable having a first center conductor and a first outer conductor having an aperture therein, with a second center conductor, comprising:

a probe having a capacitive element on a first end configured to be coupled to the second center conductor on a second end;

the probe configured for insertion into the aperture, whereby the capacitive element directly contacts the first center conductor.

* * * * *